US008644738B2

(12) United States Patent
Takashima

(10) Patent No.: US 8,644,738 B2
(45) Date of Patent: Feb. 4, 2014

(54) DEVELOPER TRANSPORTING DEVICE AND IMAGE FORMING APPARATUS

(75) Inventor: Yoshiyuki Takashima, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 252 days.

(21) Appl. No.: 13/112,799

(22) Filed: May 20, 2011

(65) Prior Publication Data

US 2012/0114386 A1 May 10, 2012

(30) Foreign Application Priority Data

Nov. 9, 2010 (JP) ..... 2010-251346

(51) Int. Cl.
*G03G 15/08* (2006.01)

(52) U.S. Cl.
USPC ..... 399/258; 399/260; 399/262

(58) Field of Classification Search
USPC ..... 399/258, 260, 262
See application file for complete search history.

(56) References Cited

FOREIGN PATENT DOCUMENTS

JP 2005-134452 A 5/2005
JP 2008-129357 A 6/2008

*Primary Examiner* — Hoang Ngo
(74) *Attorney, Agent, or Firm* — Sughrue Mion, PLLC

(57) ABSTRACT

A developer transporting device includes a transporting device body including a transporting portion in which developer is transported and which has an opening; a developer container that is detachably supported on the transporting device body and includes a containing portion for that contains the developer and has a connection hole connected to the opening, an opening-closing member that opens or closes the connection hole, and an opening-closing-member support unit that includes a guide portion that guides the opening-closing member; a movement restraining member supported on the transporting device body and restraining the opening-closing member from moving relative to the transporting device body when the developer container is attached to the transporting device body; and a releasing portion provided on the opening-closing-member support unit and releasing the opening-closing member when the opening-closing member is moved a position for closing the connection hole.

5 Claims, 10 Drawing Sheets

DEVELOPER TRANSPORTING DEVICE AND IMAGE FORMING APPARATUS

CROSS-REFERENCE TO RELATED APPLICATIONS

This application is based on and claims priority under 35 USC 119 from Japanese Patent Application No. 2010-251346 filed Nov. 9, 2010.

BACKGROUND (i) Technical Field

The present invention relates to a developer transporting device and an image forming apparatus.

(ii) Related Art

An example of an electrophotographic image forming apparatus includes a container that contains developer to be supplied and consumed in an image forming operation and a container into which developer discharged in the image forming apparatus is collected. The containers are generally replaceable and are detachably attached to the image forming apparatus.

SUMMARY

According to an aspect of the invention, there is provided a developer transporting device including a transporting device body including a transporting portion in which developer is transported, the transporting portion having an opening that allows the developer to pass therethrough; a developer container that is detachably supported on the transporting device body, the developer container including a containing portion that contains the developer therein and that has a connection hole connected to the opening so as to connect the containing portion to the transporting portion, a first opening-closing member that opens or closes the connection hole, and an opening-closing-member support unit that supports the first opening-closing member and includes a guide portion that guides the first opening-closing member in a direction for opening or closing the connection hole; a movement restraining member supported on the transporting device body, the movement restraining member coming into contact with the first opening-closing member to restrain the first opening-closing member from moving relative to the transporting device body when the developer container is attached to the transporting device body; and a releasing portion provided on the opening-closing-member support unit and coming into contact with the movement restraining member to separate the movement restraining member from the first opening-closing member so that the first opening-closing member is released from the state in which the first opening-closing member is restrained from moving relative to the transporting device body when the first opening-closing member moves relative to the connection hole in the developer container toward a position where the first opening-closing member closes the connection hole.

BRIEF DESCRIPTION OF THE DRAWINGS

An exemplary embodiment of the present invention will be described in detail based on the following figures, wherein:

FIGS. 7A and 7B illustrate the states of the main-body shutter, a supply hole, a shutter lock, the inner shutter on the cartridge, a shutter support, and a cartridge key in the process of attaching the cartridge according to the exemplary embodiment to the main body, wherein FIG. 7A illustrates the state in which the cartridge is separated from the main body and FIG. 7B illustrates the state in which the cartridge illustrated in FIG. 7A is inserted into the main body and the inner shutter on the cartridge is in contact with the shutter lock;

FIGS. 8A and 8B illustrate the states after the states in FIGS. 7A and 7B, wherein FIG. 8A illustrates the state in which the cartridge illustrated in FIG. 7B is further inserted and the cartridge key is in contact with the main-body key, and FIG. 8B illustrates the state in which the cartridge illustrated in FIG. 8A is further inserted and the cartridge key is placed in the main-body key;

FIGS. 9A and 9B illustrate the states after the states in FIGS. 8A and 8B, wherein FIG. 9A illustrates the state in which the cartridge illustrated in FIG. 8B is further inserted and the insertion of the cartridge is completed, and FIG. 9B illustrates the state in which the cartridge illustrated in FIG. 9A is pulled outward and deformation of the main-body key is suppressed.

DETAILED DESCRIPTION

An exemplary embodiment of the present invention will be described with reference to the drawings. However, the present invention is not limited to the following exemplary embodiment.

To facilitate understanding of the following descriptions, the front-back direction, the left-right direction, and the up-down direction are defined as the X-axis direction, the Y-axis direction, and the Z-axis direction, respectively, in each figure. In addition, directions shown by arrows X, −X, Y, −Y, Z, and −Z are defined as forward, backward, rightward, leftward, upward, and downward, respectively, and sides in those directions are defined as the front side, the back side, the right side, the left side, the top side, and the bottom side, respectively.

In the figures, circles having dots at the center show the direction from back to front with respect to the sides illustrated in the figures, and circles having the "x" marks therein show the direction from front to back with respect to the sides illustrated in the figures.

In each figure, components other than those necessary for the explanations are omitted to facilitate understanding.

Figure 1:
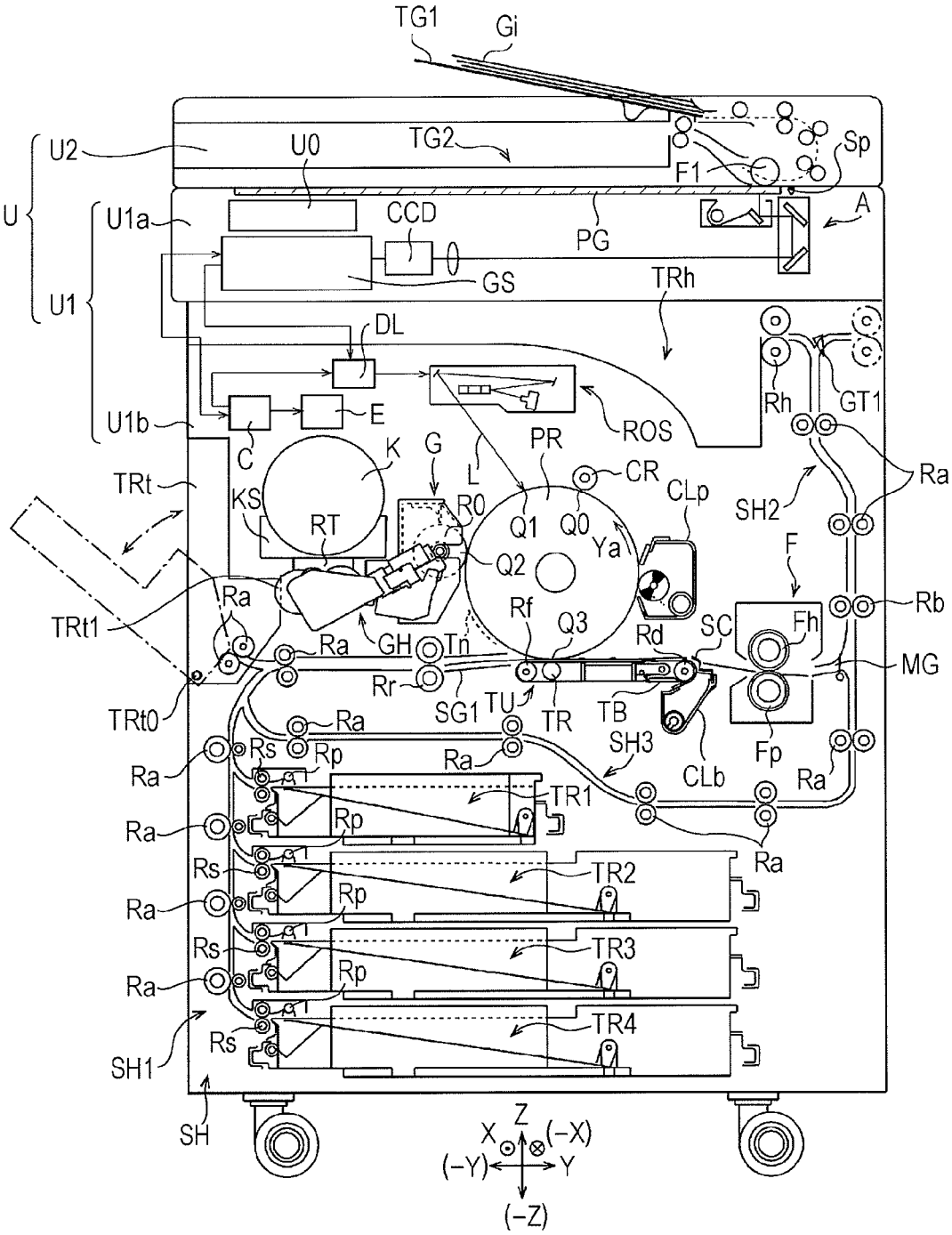
FIG. 1 illustrates an image forming apparatus including a developer transporting device according to an exemplary embodiment of the present invention.

FIG. 1 illustrates an image forming apparatus including a developer transporting device according to an exemplary embodiment of the present invention.

Referring to FIG. 1, a copy machine U is an example of the image forming apparatus according to the present exemplary embodiment. The copy machine U includes a copy machine body U1 as an example of a main body of the image forming apparatus. The copy machine body U1 includes a transparent platen glass PG, which is an example of an original document table, at the top surface thereof. An original-document transporting device U2, which is an example of an additional device, is detachably supported on the platen glass PG.

The original-document transporting device U2 includes an original document tray TG1 as an example of an original-document receiver. Sheets of original document Gi of which a copy is to be made are stacked on the original document tray TG1. The sheets of original document Gi placed on the original document tray TG1 are successively transported to a copy position F1 on the platen glass PG, and are ejected to an original-document output tray TG2, which is an example of an original-document output unit.

The copy machine body U1 includes a scanner unit U1*a*, which is an example of an image reading unit, and a printer unit U1*b*, which is an example of an image recording unit. The scanner unit U1*a* includes an input unit U0 used by an operator who performs an input operation and the platen glass PG at the top surface thereof. In the present exemplary embodiment, the scanner unit U1*a* is provided with an image processor GS.

The scanner unit U1*a* includes an exposure registration sensor Sp and an exposure optical system A. The exposure registration sensor Sp is an example of a position detection member of an exposure system, and is arranged at an original-document reading position.

The exposure optical system A is moved or stopped under the control based on a detection signal from the exposure registration sensor Sp. In a steady state, the exposure optical system A is stopped at an initial position, that is, a home position, which is an example of an image reading position.

An automatic reading operation is performed to make a copy of the original document Gi by automatically transporting the sheets of original document Gi by using the original-document transporting device U2. In this operation, the sheets of original document Gi that successively pass the copy position F1 on the platen glass PG are exposed to light from the exposure optical system A while the exposure optical system A is stopped at the home position.

A manual reading operation is performed when a user manually places each sheet of original document Gi on the platen glass PG to make a copy of the original document Gi. In this operation, each sheet of original document Gi placed on the platen glass PG is exposed to light from the exposure optical system A while the exposure optical system A is moving.

The light is reflected by the sheet of original document Gi, passes through the exposure optical system A, and is focused on a solid-state imaging device CCD, which is an example of an image-pickup element. The solid-state imaging device CCD converts the light reflected by the sheet of original document Gi and focused on an imaging surface of the solid-state imaging device CCD into an electrical signal.

The image processor GS receives a read image signal from the CCD in the scanner unit U1*a*, converts the received signal into a digital image write signal, and outputs the image write signal to an image write circuit DL included in the printer unit U1*b*.

The image write circuit DL receives the image write signal, generates a drive signal for forming a latent image that corresponds to the image write signal, and outputs the drive signal to an exposure device ROS, which is an example of a latent-image forming device.

A photoconductor drum PR, which is an example of an image carrier, is disposed below the exposure device ROS. The photoconductor drum PR rotates in the direction shown by arrow Ya. The surface of the photoconductor drum PR is charged by a charging roller CR, which is an example of a charging device, in a charging area Q0. Then, the surface of the photoconductor drum PR is exposed to and scanned with a laser beam L, which is an example of latent-image writing light emitted from the exposure device ROS, at a latent-image writing position Q1. Thus, a latent image is formed. The surface of the photoconductor drum PR on which the latent image is formed is moved as the photoconductor drum PR rotates, and successively passes through a developing area Q2 and a transfer area Q3.

A developing device G is opposed to the photoconductor drum PR in the developing area Q2. The developing device G includes a developing roller R0, which is an example of a developer carrier, for transporting the developer to the developing area Q2. The developing device G forms a toner image, which is an example of a visible image, by developing the electrostatic latent image that passes through the developing area Q2.

A cartridge K, which is an example of a developer container for supplying the developer to be consumed by the developing device G, is disposed on the left side of the developing device G. The cartridge K is detachably attached to a cartridge holder KS, which is an example of a container holder. The developer contained in the cartridge K is transported while being stirred in a reservoir tank RT, which is an example of a temporal reservoir, and is supplied to the developing device G by a transporting system GH that is connected to the reservoir tank RT.

Paper feed trays TR1 to TR4, which are examples of medium storage units, are detachably supported in an area below the copy machine body U1. Recording sheets S, which are examples of media, are stored in the paper feed trays TR1 to TR4.

The sheets S on the trays TR1 to TR4 are fed by pick-up rollers Rp, which are examples of pick-up members, at a predetermined paper-feed time, and are separated from each other by separation rollers Rs, which are examples of separation members. Then, each sheet S is transported by plural transport rollers Ra, which are examples of medium transport members, to registration rollers Rr, which are examples of feeding members.

A manual feed tray TRt, which is an example of a manual feed unit, is disposed on the left side of the cartridge holder KS and the reservoir tank RT. Sheets S fed from the manual feed tray TRt are also transported to the registration rollers Rr. The manual feed tray TRt according to the present exemplary embodiment is supported such that the manual feed tray TRt is rotatable around a rotational center TRt0. When the manual feed tray TRt is placed in the image forming apparatus U, as shown by the solid lines in FIG. 1, a part TRt1 of the manual feed tray TRt that is near the rotational center TRt0 thereof is located in a space below the cartridge holder KS and on the left side of the reservoir tank RT. Thus, the manual feed tray TRt is space-efficiently arranged manner and the overall size of the copy machine U is reduced.

Each sheet S that has been transported to the registration rollers Rr is transported from a pre-transfer sheet guide SG1, which is an example of a pre-transfer guiding member, to the transfer area Q3 in synchronization with the time at which the toner image on the surface of the photoconductor drum PR is moved to the transfer area Q3.

A transfer unit TU, which is an example of a transfer device or a transfer-transport device, is opposed to the photoconductor drum PR in the transfer area Q3. The transfer unit TU includes a transfer-transport belt TB, which is an example of a medium transporting member. The transfer-transport belt TB supports the recording sheet S that has been transported to the transfer area Q3 on the surface thereof, and transports the recording sheet S. The transfer-transport belt TB is rotatably supported by belt support rollers Rd+Rf, which are examples of medium-transporting-member support units. The belt support rollers include Rd+Rf a driving roller Rd, which is an example of a driving member, and a driven roller Rf, which is an example of a driven member. A transfer roller TR, which is an example of a transfer member, is opposed to the photoconductor drum PR with the transfer-transport belt TB disposed therebetween.

A transfer voltage is applied to the transfer roller TR by a power supply circuit E controlled by a controller C, which is an example of a control unit. Accordingly, a toner image Tn on the surface of the photoconductor drum PR is transferred onto the recording sheet S that passes through the transfer area Q3.

After the transfer process, residual toner that remains on the surface of the photoconductor drum PR is removed by a photoconductor cleaner CLp, which is an example of an image-carrier cleaner. Then, the surface of the photoconductor drum PR is charged again by the charging roller CR.

A separating claw SC, which is an example of a medium-separating member, is opposed to the driving roller Rd with the transfer-transport belt TB interposed therebetween. The sheet S onto which the toner image has been transferred by the transfer roller TR in the transfer area Q3 is separated from the surface of the transfer-transport belt TB by the separating claw SC at a position downstream of the transfer area Q3.

A belt cleaner CLb, which is an example of a medium-transporting-member cleaner, is disposed downstream of the separating claw SC in the rotational direction of the transfer-transport belt TB. The belt cleaner CLb removes the developer, paper dust, etc., from the surface of the transfer-transport belt TB after the recording sheet S is separated therefrom.

The separated sheet S is transported to a fixing device F which includes a heating roller Fh, which is an example of a heat-fixing member, and a pressing roller Fp, which is an example of a pressure-fixing member. The fixing device F fixes the toner image to the sheet S by applying heat and pressure. The sheet S to which the toner image has been fixed passes through a first gate MG, which is an example of a switch member made of an elastic material, while elastically deforming the first gate MG. Then, the recording sheet S is transported to transport rollers Rb, which are rotatable in both normal and reverse directions, on a sheet ejection path SH2, which is an example of a medium ejection path.

The sheet S is transported along the sheet ejection path SH2 on which the transport rollers Rb that are rotatable in both normal and reverse directions and plural transport rollers Ra are arranged, and is ejected to a paper output tray TRh. A second gate GT1, which is an example of a switch member, is disposed at the downstream end of the sheet ejection path SH2. In the case where a post-processing device (not shown) is connected to the copy machine U, the second gate GT1 selectively ejects the sheet S to either the paper output tray TRh, which is an example of a medium output unit, or the post-processing device (not shown). In the case where no post-processing device is connected, the second gate GT1 ejects the sheet S that has been transported to the downstream end of the sheet ejection path SH2 to the paper output tray TRh.

In the case where duplex printing is performed, when the sheet S having an image formed on one side thereof is transported to the transport rollers Rb that are rotatable in both normal and reverse directions, the transport rollers Rb start to rotate in the reverse direction before the trailing edge of the recording sheet S passes the transport rollers Rb. Accordingly, the sheet S is transported backward in a so-called switchback manner in the sheet ejection path SH2. The first gate MG guides the sheet S that has been transported backward by the transport rollers Rb in the switchback manner toward a circulation transport path SH3, which is an example of a circulation path. The sheet S that has been transported to the circulation transport path SH3 is transported to the transfer area Q3 again in a reversed manner. Thus, the sheet S having an image formed on a first side thereof is transported to the transfer area Q3 again, and a toner image is transferred onto a second side of the recording sheet S.

A medium transporting device SH according to the present exemplary embodiment includes the above-described components denoted by SH1 to SH3, Rp, Rs, Rr, Ra, Rb, and MG.

Description of Developer Transporting Device

Figure 2:
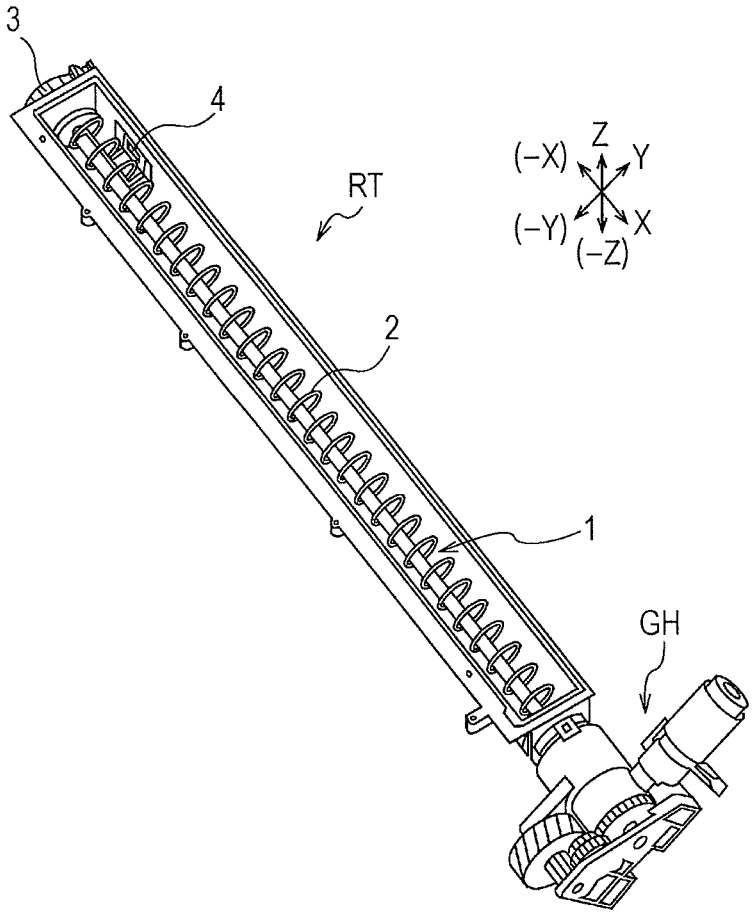
FIG. 2 illustrates a reservoir tank according to the exemplary embodiment.

FIG. 2 illustrates the reservoir tank RT according to the present exemplary embodiment.

Referring to FIG. 2, the reservoir tank RT according to the present exemplary embodiment includes a tank body 1 as an example of a transporting unit. The tank body 1 extends in the front-back direction and contains the developer therein. A supplying auger 2, which is an example of a transporting member, is rotatably supported in the tank body 1 such that the supplying auger 2 extends in the front-back direction. A supply gear 3, which is an example of a rotation-transmitting member, is supported at the back end of the supplying auger 2. Rotation of a drive source (not shown) is transmitted to the supply gear 3. Accordingly, the developer in the tank body 1 is transported in the direction from back to front. An empty-state detection sensor 4, which is an example of a detection member, is provided on a side wall of the tank body 1 at the back end thereof. The empty-state detection sensor 4 determines whether or not the cartridge K is empty by detecting the developer that flows into the tank body 1.

The transporting system GH is provided at the front end of the tank body 1. The transporting system GH transports the developer that has been transported to the front end of the tank body 1 by the supplying auger 2 to the developing device G. The transporting system GH is commonly known, and a system described in Japanese Unexamined Patent Application Publication No. 2008-129357, for example, may be used. Various types of transporting systems may be used as the transporting system GH, and detailed explanations thereof are thus omitted.

Figure 3:
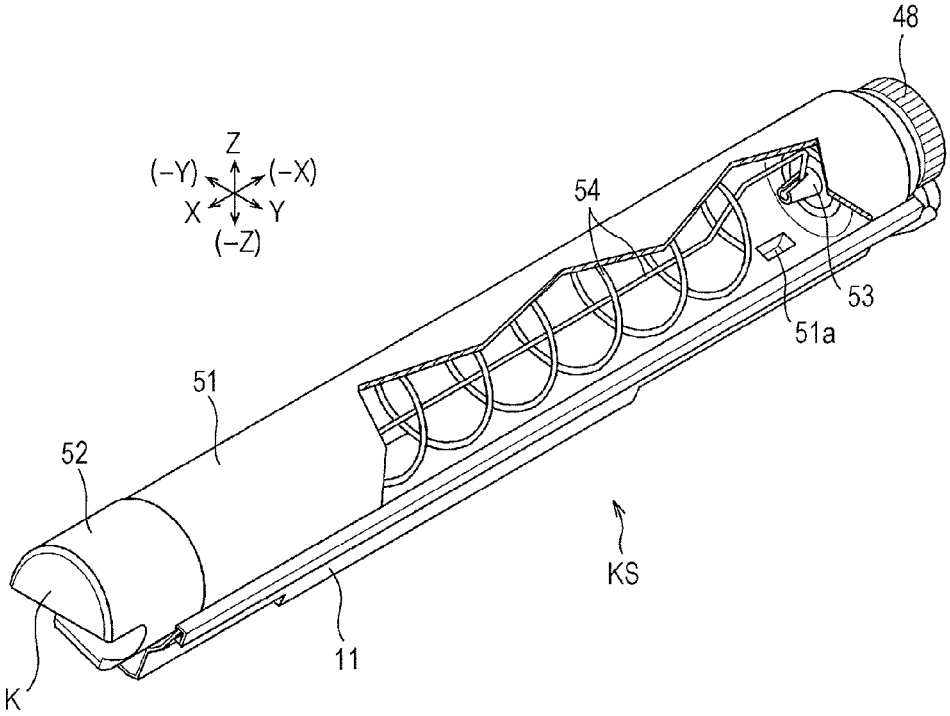
FIG. 3 is a perspective view illustrating the state in which a toner cartridge is attached to a cartridge holder according to the exemplary embodiment.

FIG. 3 is a perspective view illustrating the state in which the toner cartridge K is attached to the cartridge holder KS according to the present exemplary embodiment.

Figure 4A:
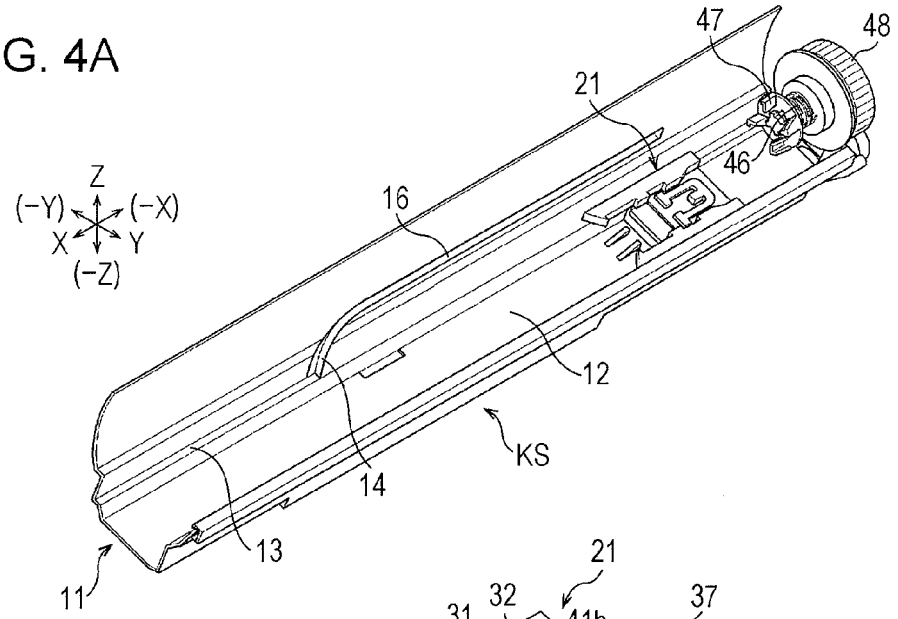
FIG. 4A illustrates the state in which the toner cartridge illustrated in FIG. 3 is removed from the cartridge holder.

FIG. 4A illustrates the state in which the toner cartridge K illustrated in FIG. 3 is removed from the cartridge holder KS.

Figure 4B:
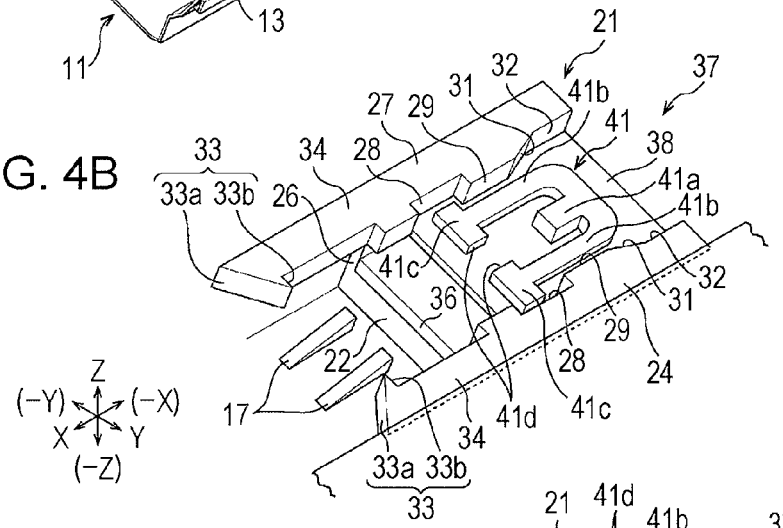
FIG. 4B illustrates a part of the cartridge holder in the state in which a main-body shutter is at a closed position.
Figure 4C:
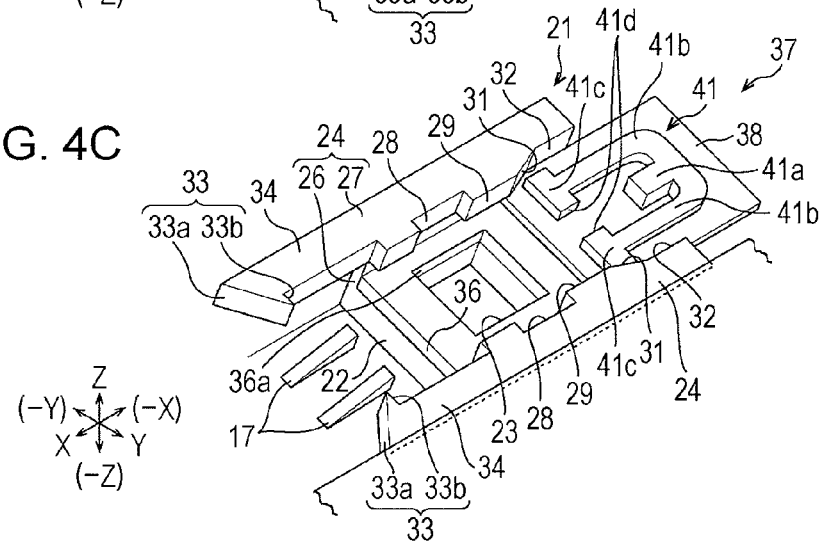
FIG. 4C illustrates the part of the cartridge holder in the state in which the main-body shutter is at an open position.

FIG. 4B illustrates a part of the cartridge holder KS in the state in which a main-body shutter 37 is at a closed position. FIG. 4C illustrates the part of the cartridge holder KS in the state in which the main-body shutter 37 is at an open position.

Referring to FIGS. 1, 3, and 4A, the cartridge holder KS is supported above the reservoir tank RT, and includes a holder body 11, which is an example of a container support body. The holder body 11 extends in the front-back direction. The holder body 11 has a substantially cylindrical inner peripheral surface, and a shutter passage 12, which is an example of an opening-closing passage, is formed at the bottom of the holder body 11. The shutter passage 12 is recessed downward and extends in the front-back direction.

Referring to FIG. 4A, a step-shaped shutter projection passage 13, which is an example of a contact-body passage, is formed in the upper left area of the shutter passage 12. A first projection guide groove 14, which is an example of a first contact guide portion, is provided behind the shutter projection passage 13. The first projection guide groove 14 is formed as a helical recessed portion that extends from a central position of the holder body 11 in the front-back direction toward the upper left and back along the inner peripheral surface of the holder body 11. A second projection guide groove 16, which is an example of a second contact guide portion, is formed so as to extend continuously from the top end of the first projection guide groove 14. The second projection guide groove 16 is formed as a recessed portion that extends backward. Referring to FIGS. 4A to 4C, plural rattling preventing ribs 17, which are examples of rattling preventing portions, are formed in a back area of the shutter passage 12. The rattling preventing ribs 17 are inclined upward toward the back.

Description of Shutter Lock

A shutter lock 21, which is an example of a movement restraining member, is provided behind the rattling preventing ribs 17. The shutter lock 21 includes a bottom portion 22 at the bottom end thereof, and a supply hole 23, which is an example of an opening, is provided at a central area of the bottom portion 22. The supply hole 23 extends through the holder body 11 in the up-down direction. Referring to FIG. 2, the supply hole 23 opens into the reservoir tank RT at a position above the position where the empty-state detection sensor 4 is disposed at the back end of the reservoir tank RT.

Main-body shutter guides 24, which are examples guide portions for guiding a main-body opening-closing member, are formed integrally with the shutter lock 21 at the left and right sides thereof. The main-body shutter guides 24 extend in the front-back direction. According to the present exemplary embodiment, the main-body shutter guides 24 include left and right vertical wall portions 26 that extend upward from the left and right sides of the bottom portion 22, and top wall portions 27 that extend inward from the top ends of the vertical wall portions 26.

Accommodation recesses 28, which are examples of deformation-allowing portions, are formed in inner side surfaces of the top wall portions 27 in the left-right direction at the front end thereof. The accommodation recesses 28 are recessed outward in the left-right direction. Narrowing portions 29, inclined portions 31, and broadening portions 32 are formed on the inner side surfaces of the top wall portions 27 in the area behind the accommodation recesses 28. The narrowing portions 29 are examples of deformation-restraining portions, and extend backward. The inclined portions 31 are examples of guide portions, and extend from the back ends of the narrowing portions 29 such that the inclined portions 31 are inclined outward in the left-right direction toward the back. The broadening portions 32 are examples of second deformation-allowing portions, and extend from the back ends of the inclined portions 31 so as to extend backward.

Left and right lock arms 34, which are examples of restraining-member bodies, are formed integrally with the shutter lock 21 so as to extend forward from the top wall portions 27. Locking claws 33, which are examples of contact portions, are formed so as to project inward in the left-right direction at the front ends of the lock arms 34. The locking claws 33 include front guide surfaces 33*a*, which are examples of guide portions used in an attaching process, and back end faces 33*b*. The front guide surfaces 33*a* are front end faces that are inclined inward in the left-right direction toward the back. The back end faces 33*b* extend in the left-right direction from the inner ends of the front guide surfaces 33*a*.

Referring to FIGS. 4A to 4C, a plate-shaped main-body sealing member 36, which is an example of a leakage preventing member, is supported on the top surface of the bottom portion 22. In the present exemplary embodiment, the main-body sealing member 36 is composed of a sponge, which is an example of an elastic material. An opening 36*a* that corresponds to the supply hole 23 is formed in the main-body sealing member 36.

Description of Main-Body Shutter

The main-body shutter 37, which is an example of a main-body opening-closing member, is supported on the top surface of the main-body sealing member 36. According to the present exemplary embodiment, the main-body shutter 37 includes a plate-shaped shutter body 38, which is an example of an opening-closing-member body. The bottom surface of the shutter body 38 comes into contact with the main-body sealing member 36, so that the risk of leakage of the developer is reduced.

The shutter body 38 is supported by the main-body shutter guides 24 at the left and right sides thereof such that the shutter body 38 is movable in the front-back direction. The shutter body 38 moves forward to the closed position illustrated in FIG. 4B at which the shutter body 38 blocks the supply hole 23, or backward to the open position illustrated in FIG. 4C at which the shutter body 38 does not block the supply hole 23.

A main-body key 41, which is an example of a main-body engagement member, is supported on the top surface of the shutter body 38. The main-body key 41 is substantially U-shaped as a whole, and is connected to the shutter body 38 at a back end portion 41*a* thereof that is positioned at a central position in the left-right direction. The main-body key 41 includes left and right engagement arms 41*b*, which are examples of deforming portions. The engagement arms 41*b* extend forward from the back end portion 41*a* and are elastically deformable. Outer claw portions 41*c*, which are examples of restraining contact portions, and inner claw portions 41*d*, which are examples of engagement retaining portions, are provided at the front ends of the engagement arms 41*b*. The outer claw portions 41*c* project outward in the left-right direction and the inner claw portions 41*d* project inward in the left-right direction. In the present exemplary embodiment, the distance between the outer ends of the outer claw portions 41*c* is set in accordance with the distance between the broadening portions 32, more specifically, to a distance smaller than the distance between the accommodation recesses 28 and larger than the distance between the narrowing portions 29.

Referring to FIGS. 3 and 4A, a rotational shaft 46 is rotatably supported on the back end wall (not shown) at the back end of the holder body 11. A coupling 47, which is an example of a rotation-transmitting member, is supported at the front end of the rotational shaft 46. A cartridge driving gear 48, which is also an example of a rotation-transmitting member, is supported at the back end of the rotational shaft 46. The cartridge driving gear 48 is configured such that rotation of a drive source (not shown) may be transmitted thereto.

The cartridge holder KS according to the present exemplary embodiment includes the components denoted by reference numerals 11 to 48. The components denoted by reference numerals 11 to 48, in other words, the reservoir tank RT and the cartridge holder KS, form a transporting device body RT+KS according to the present exemplary embodiment.

Description of Cartridge

Referring to FIG. 3, the cartridge K according to the present exemplary embodiment includes a cylindrical cartridge body 51, which is an example of a developer containing portion. The cartridge body 51 extends in the front-back direction and contains therein the developer to be supplied. An outlet 51*a*, which is an example of a connection hole, is formed in the cartridge body 51 at the back end thereof. The developer in the cartridge body 51 flows out of the cartridge body 51 through the outlet 51*a*.

A handle 52, which is an example of a handle portion, to be grabbed by a user is provided at the front end of the cartridge body 51.

A coupling 53, which is also an example of a rotation-transmitting member, is rotatably provided in the cartridge body 51 at the back end thereof. The coupling 53 meshes with the coupling 47, which is a main-body rotation-transmitting member, so that rotation is transmitted to the coupling 53. The back end of an agitator 54, which is an example of a developer transporting member, is connected to the coupling 53. In the present exemplary embodiment, the agitator 54 is formed in the shape of a coil spring, that is, in the shape obtained by helically winding a wire. When the coupling 53 is rotated, the agitator 54 transports the developer in the cartridge body 51 toward the outlet 51*a*.

Description of Inner Shutter and Guides Thereof

Figure 5A:
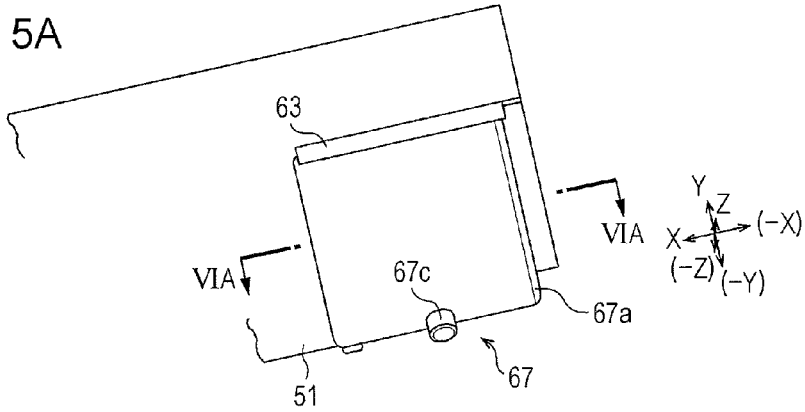
FIG. 5A illustrates a shutter unit on the cartridge according to the exemplary embodiment in the state in which an outer shutter is at a closed position.
Figure 5B:
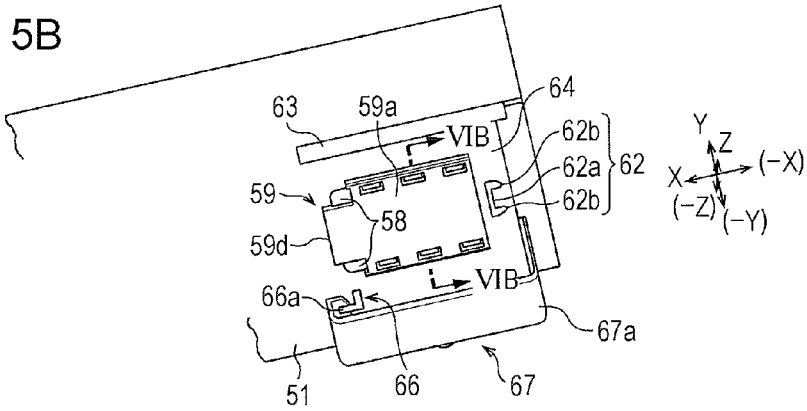
FIG. 5B illustrates the shutter unit on the cartridge in the state in which the outer shutter is at an open position and an inner shutter is at a closed position.
Figure 5C:
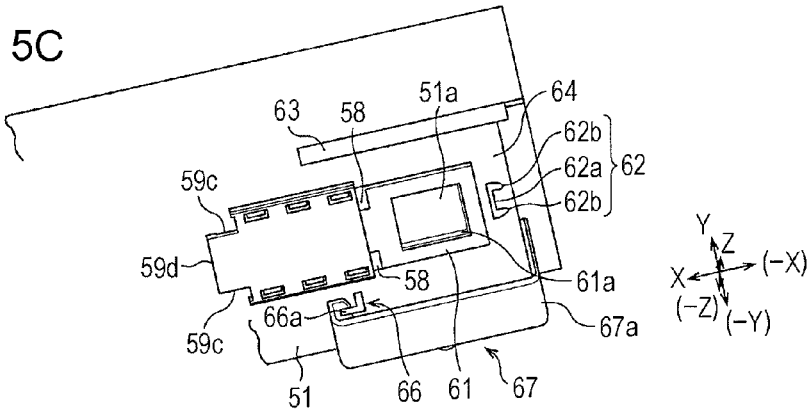
FIG. 5C illustrates the shutter unit on the cartridge in the state in which the outer shutter and the inner shutter are at the respective open positions.

FIG. 5A illustrates a shutter unit provided on the cartridge K according to the present exemplary embodiment in the state in which an outer shutter 67 is at a closed position. FIG. 5B illustrates the shutter unit in the state in which the outer shutter 67 is at an open position and an inner shutter 59 is at a closed position. FIG. 5C illustrates the shutter unit in the state in which the outer shutter 67 and the inner shutter 59 are at the respective open positions.

Figure 6A:
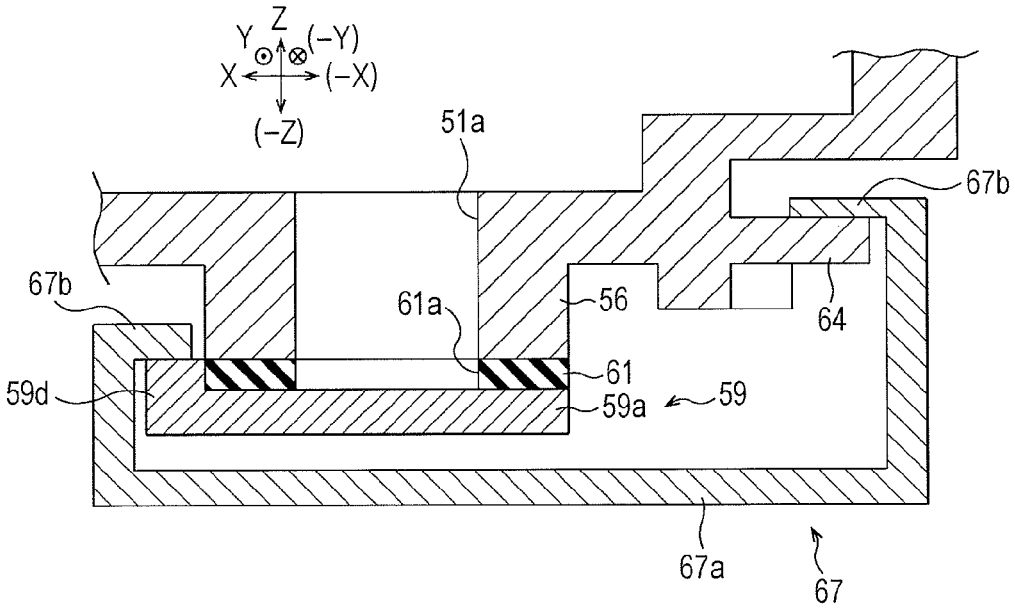
FIG. 6A is a sectional view of a shutter support according to the exemplary embodiment taken along line VIA-VIA in FIG. 5A.
Figure 6B:
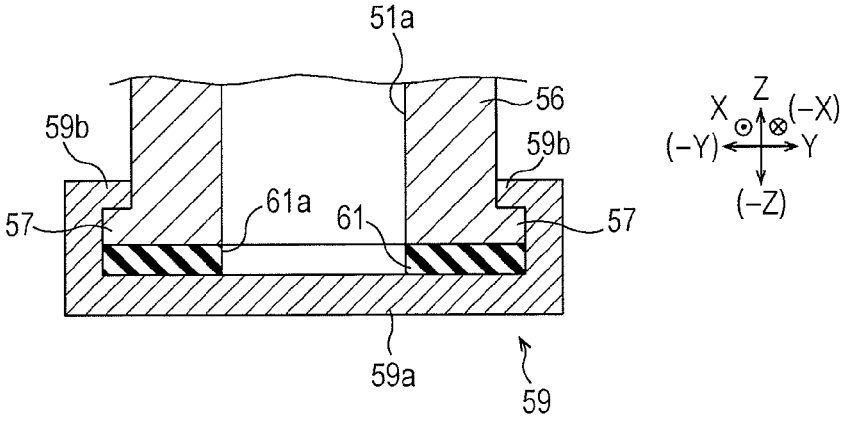
FIG. 6B is a sectional view of the shutter support according to the exemplary embodiment taken along line VIB-VIB in FIG. 5B.

FIG. 6A is a sectional view of a shutter support 56 according to the present exemplary embodiment taken along line VIA-VIA in FIG. 5A. FIG. 6B is a sectional view of the shutter support 56 taken along line VIB-VIB in FIG. 5B.

Referring to FIGS. 5A to 6B, the shutter support 56, which is an example of an opening-closing-member support unit, is formed so as to project radially outward at the outer surface side of the outlet 51*a* at the back end of the cartridge body 51. As illustrated in FIG. 6B, the shutter support 56 is provided with inner shutter guides 57, which are examples of guide portions, at the left and right sides thereof. The inner shutter guides 57 protrude outward in the left-right direction.

Referring to FIGS. 5B and 5C, engagement cancelling portions 58, which are examples of releasing portions, are formed at the front end of the shutter support 56, that is, at the downstream end thereof in the direction in which the cartridge K is detached. In the present exemplary embodiment, the engagement cancelling portions 58 are formed so as to extend from the inner shutter guides 57 at the front ends thereof, and provides the function of the inner shutter guides 57. In other words, the engagement cancelling portions 58 according to the present exemplary embodiment are formed integrally with the inner shutter guides 57 and function also as the inner shutter guides 57.

Referring to FIGS. 5B and 5C, the inner shutter 59, which is an example of a first opening-closing member, is supported by the inner shutter guides 57 such that the inner shutter 59 is movable in the front-back direction. The inner shutter 59 includes a plate-shaped inner shutter body 59*a*, which is an example of an opening-closing member body. Inner guide portions 59*b*, which are examples of guided portions, are formed at the left and right sides of the inner shutter body 59*a*. The inner guide portions 59*b* extend in the front-back direction and are guided by the inner shutter guides 57. Thus, the inner shutter 59 according to the present exemplary embodiment is supported such that the inner shutter 59 is movable between the closed position illustrated in FIG. 5B at which the inner shutter 59 blocks the outlet 51*a* and the open position illustrated in FIG. 5C at which the inner shutter 59 does not block the outlet 51*a*.

Left and right notched portions 59*c*, which are examples of releasing-portion receivers, are formed at the front end of the inner shutter body 59*a*. The notched portions 59*c* are formed so as to correspond to the engagement cancelling portions 58 such that the engagement cancelling portions 58 are outwardly exposed at the notched portions 59*c*. Referring to FIGS. 5B and 6A, an outer-shutter extension guide 59*d*, which is an example of a second opening-closing member guide portion, is formed between the notched portions 59*c*. When the inner shutter 59 is at the closed position, the extension guide 59*d* projects forward beyond a front edge of the shutter support 56.

The inner shutter 59 according to the present exemplary embodiment is configured to be placed between the lock arms 34 when the cartridge K is attached to the cartridge holder KS. Accordingly, the width of the inner shutter 59 in the left-right direction corresponds to the distance between the lock arms 34. In addition, with regard to the length of the inner shutter 59 in the front-back direction, the distance from the back end of the inner shutter 59 to the back ends of the notched portions 59*c* corresponds to the distance from the front end of the main-body sealing member 36 to the back end faces 33*b* of the locking claws 33. The thickness of the inner shutter body 59*a* of the inner shutter 59 is set such that the top surface of the inner shutter body 59*a* is flush with the top surface of the main-body sealing member 36.

Referring to FIGS. 5A to 6B, a cartridge sealing member 61, which is an example of a leakage preventing member, is provided between the outer surface of the shutter support 56 and the inner shutter 59. The cartridge sealing member 61 is made of an elastic material, and prevents leakage of the developer through a gap between the inner shutter 59 and the shutter support 56. As illustrated in FIG. 5C, an opening 61*a* which corresponds to the outlet 51*a* is formed in the cartridge sealing member 61 at a central area thereof. The shape of the cartridge sealing member 61 according to the present exemplary embodiment corresponds to the shape of the inner shutter 59. The cartridge sealing member 61 is not provided in areas corresponding to the notched portions 59*c* in the inner shutter 59, that is, in the areas corresponding to the engagement cancelling portions 58.

In the present exemplary embodiment, the vertical distance from the top surfaces of the inner shutter guides 57 to the bottom surface of the cartridge sealing member 61 corresponds to the vertical distance from the bottom surfaces of the main-body shutter guides 24 to the top surface of the main-body sealing member 36. In addition, the width of the shutter support 56 in the left-right direction is smaller than the distance between the narrowing portions 29 of the shutter lock 21, and the distance between the outer ends of the inner shutter guides 57 in the left-right direction is smaller than the distance between the main-body shutter guides 24. Accordingly, when the cartridge K is attached to the cartridge holder KS, the inner shutter guides 57 are guided by the main-body shutter guides 24 and the shutter support 56 is placed in the shutter lock 21. As a result, the outlet 51*a* is connected to the supply hole 23.

Referring to FIGS. 5A to 6B, a cartridge key 62, which is an example of a container engagement member, is formed so as to project radially outward from the outer peripheral surface of the cartridge body 51 at a position behind the shutter support 56. The cartridge key 62 substantially has the shape of a letter 'U' that faces backward, and includes a front end portion 62*a* that extends in the left-right direction and insertion portions 62*b* that extend backward from the left and right ends of the front end portion 62*a*. The insertion portions 62*b* are formed such that outer side surfaces thereof in the left-right direction are inclined inward in the left-right direction toward the back.

The size of the cartridge key 62 according to the present exemplary embodiment is set such that the cartridge key 62 may be placed in the main-body key 41 of the main-body shutter 37. The length of the front end portion 62*a* in the left-right direction is smaller than the distance between the engagement arms 41*b* and larger than the distance between the inner ends of the inner claw portions 41*d*. The distance between the back ends of the insertion portions 62*b*, that is, the downstream end thereof in the direction in which the cartridge K is attached, is smaller than the distance between the inner ends of the inner claw portions 41*d*.

Description of Outer Shutter and Guides Thereof

Referring to FIGS. 5A to 5C, an outer shutter stopper 63, which is an example of a second opening-closing member stopper, is formed so as to extend in the front-back direction and project outward on the outer surface of the cartridge body 51 at a position on the right of the shutter support 56.

As illustrated in FIGS. 5B, 5C, and 6A, an outer-shutter back guide 64, which is also an example of a second opening-closing member guide portion, is formed at the back end of the cartridge body 51. The outer-shutter back guide 64 protrudes backward in an arc shape along the cartridge body 51. In FIG. 5C, an outer-shutter front guide 66, which is also an example of a second opening-closing member guide portion, is formed at a position on the left of the shutter support 56. The outer-shutter front guide 66 is formed in an ark shape on the extension of the outer-shutter extension guide 59*d* in the circumferential direction. A right end 66*a* of the outer-shutter front guide 66 is located at a position separated from the shutter support 56 in the circumferential direction of the cartridge body 51 so that the outer-shutter front guide 66 does not interfere with the movement of the inner shutter 59.

Referring to FIGS. 5A to 6A, the outer shutter 67, which is an example of a second opening-closing member, is supported by the outer shutter guides 64, 66, and 59*d*. The outer shutter 67 includes an outer shutter body 67*a*, which is an example of a second opening-closing member body. The outer shutter body 67*a* has a partial cylindrical shape that extends along the outer peripheral surface of the cartridge body 51. Outer guide portions 67*b*, which are examples of guided portions, are formed at the front and back ends of the outer shutter body 67*a*. The outer guide portions 67*b* are guided by the outer-shutter guides 64, 66, and 59*d*. Thus, the outer shutter 67 is supported such that the outer shutter 67 is moveable along the outer-shutter guides 64, 66, and 59*d* in the circumferential direction of the cartridge body 51. The outer shutter 67 is moveable between a second closed position illustrated in FIG. 5A at which the outer shutter 67 blocks the outlet 51*a* and covers the inner shutter 59 and a second open position illustrated in FIG. 5B at which the outer shutter 67 does not cover the inner shutter 59.

As illustrated in FIG. 5A, an outer opening-closing projection 67*c*, which is an example of a contact body, is formed on the outer surface of the outer shutter 67 so as to project outward. The outer opening-closing projection 67*c* is formed so as to correspond to the shutter passage 12, and is capable of coming into contact with the inner side surfaces of the projection guide grooves 14 and 16.

The cartridge K, which is an example of a developer container according to the present exemplary embodiment, includes the components denoted by reference numerals 51 to 67. A developer transporting device RT+KS+K according to the present exemplary embodiment includes the transporting device body RT+KS and the cartridge K.

Operation of Exemplary Embodiment

In the copy machine U according to the present exemplary embodiment including the above-described components, a latent image formed on the surface of the photoconductor drum PR is developed by the developing device G in the developing area Q2. Thus, the developer in the developing device G is consumed. As the developer in the developing device G is consumed, the supplying auger 2 and the transporting system GH are operated to supply the developer from the cartridge K in accordance with the amount of consumption.

When, for example, all the developer in the cartridge K is supplied and the cartridge K becomes empty or when the cartridge K does not function properly, the cartridge K is replaced with a new cartridge K by pulling out the old cartridge K and inserting the new cartridge K in the front-back direction of the copy machine body U1.

Description of Cartridge Attaching Operation

Referring to FIGS. 3 to 5A, when the cartridge K is inserted into the cartridge holder KS from the front, the outer opening-closing projection 67*c* on the outer shutter 67 moves backward along the shutter passage 12 and comes into contact with the bottom end of the first projection guide groove 14. Then, when the cartridge K is further inserted, the outer opening-closing projection 67*c* is guided along the first projection guide groove 14 so that the outer shutter 67 is moved upward along the circumferential direction of the cartridge body 51. Thus, when the cartridge K is inserted by being moved backward, the outer shutter 67 is moved in the circumferential direction from the closed position illustrated in FIG. 5A to the open position illustrated in FIGS. 5B and 5C. As a result, the inner shutter 59 is exposed.

Figure 7A:
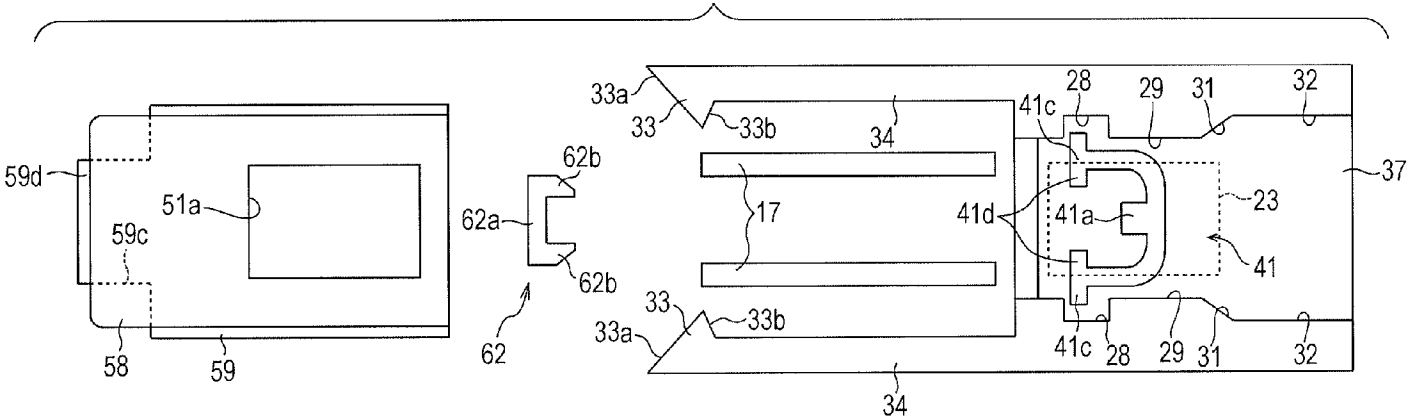
Figure 7B:
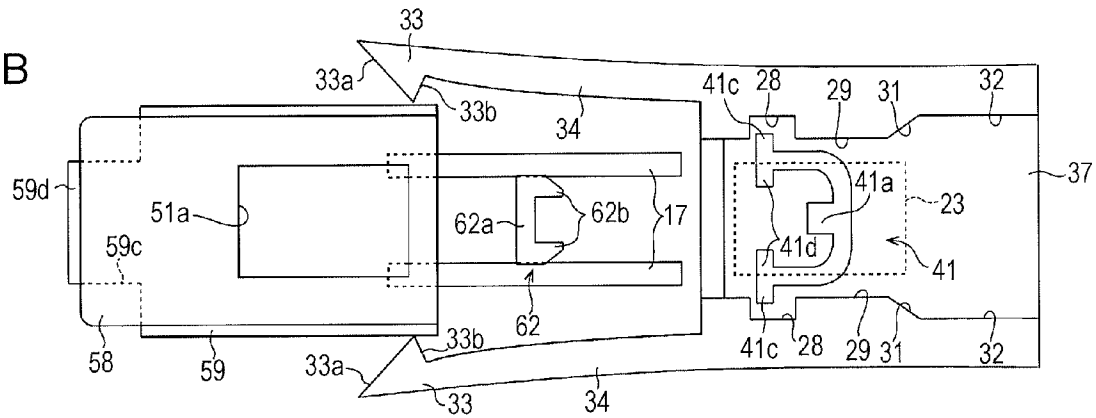

FIGS. 7A and 7B illustrate the states of the main-body shutter 37, the supply hole 23, the shutter lock 21, the inner shutter 59 on the cartridge K, the shutter support 56, and the cartridge key 62 in the process of attaching the cartridge K according to the present exemplary embodiment to the main body. FIG. 7A illustrates the state in which the cartridge K is separated from the main body. FIG. 7B illustrates the state in which the cartridge K illustrated in FIG. 7A is inserted into the main body and the inner shutter 59 on the cartridge K is in contact with the shutter lock 21.

Referring to FIGS. 7A and 7B, when the cartridge K is further inserted into the main body while the inner shutter 59 is exposed, the inner shutter 59 in the state illustrated in FIG. 7A approaches the shutter lock 21. Then, the cartridge key 62 moves backward through the space between the locking claws 33, and the back end of the inner shutter 59, that is, the downstream end thereof in the direction in which the cartridge K is attached, comes into contact with the front guide surfaces 33*a* of the lock arms 34. Then, when the cartridge K in this state is further inserted, the lock arms 34 are elastically deformed outward, as illustrated in FIG. 7B. Accordingly, the inner shutter 59 and the shutter support 56 on the cartridge K may be moved further backward.

Figure 8A:
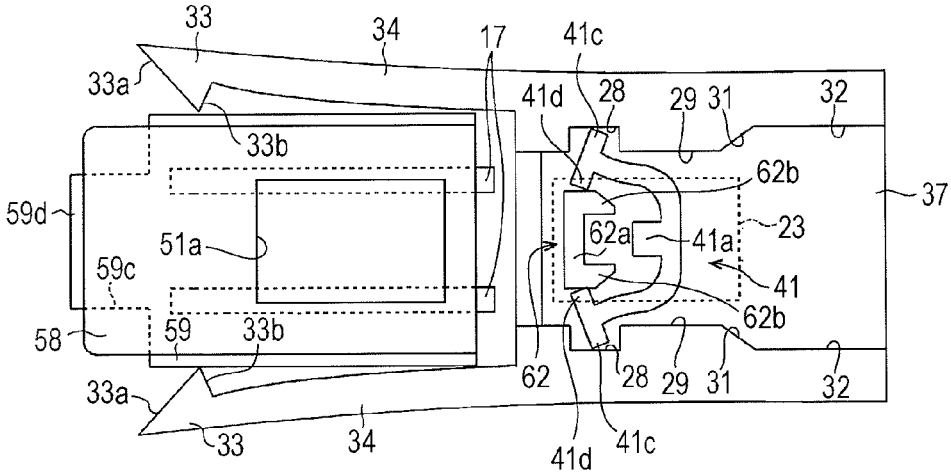
Figure 8B:
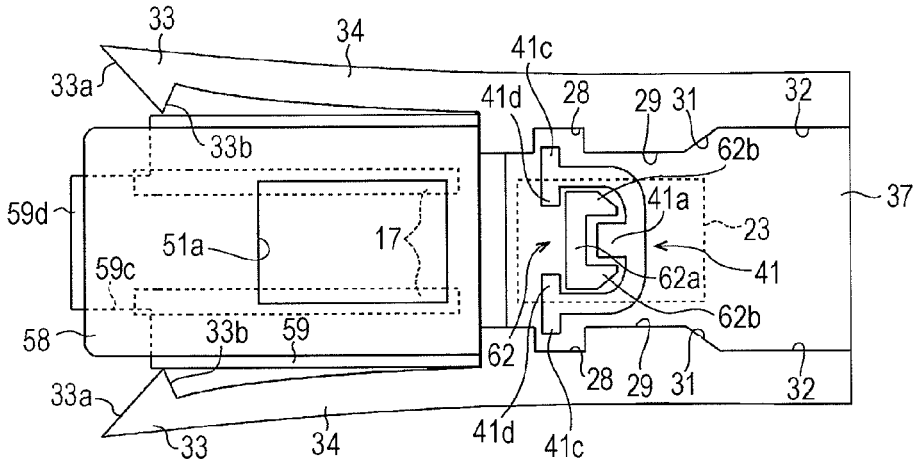

FIGS. 8A and 8B illustrate the states after the states in FIGS. 7A and 7B. FIG. 8A illustrates the state in which the cartridge K illustrated in FIG. 7B is further inserted and the cartridge key 62 is in contact with the main-body key 41. FIG. 8B illustrates the state in which the cartridge K illustrated in FIG. 8A is further inserted and the cartridge key 62 is placed in the main-body key 41.

When the cartridge K in the state illustrated in FIG. 7B is further moved backward, the bottom surface of the inner shutter 59 is guided and pushed upward by the rattling preventing ribs 17. Accordingly, rattling in the vertical direction is suppressed and the inner shutter 59 is positioned in the vertical direction. When the cartridge key 62 reaches the main-body key 41, the insertion portions 62*b* of the cartridge key 62 are inserted into the space between the inner claw portions 41*d* and try to push the engagement arms 41*b* away from each other. At this time, the outer claw portions 41*c* are placed in the accommodation recesses 28 in the shutter lock 21, and are therefore allowed to move outward in the left-right direction. Therefore, as illustrated in FIG. 8A, the engagement arms 41*b* are elastically deformed and pushed outward.

Then, when the cartridge K in the state illustrated in FIG. 8A is further moved backward and the cartridge key 62 is placed in the main-body key 41, the engagement arms 41*b* elastically restore their original shapes, as illustrated in FIG. 8B. Accordingly, the inner claw portions 41*d* face each other in front of the front face of the front end portion 62*a* of the cartridge key 62. Thus, the cartridge key 62 is restrained from moving with respect to the main-body shutter 37. In other words, the cartridge key 62 is locked.

When the cartridge K in the state illustrated in FIG. 8B is further moved backward, the cartridge key 62 pushes the main-body key 41 and the main-body shutter 37 moves backward. More specifically, the main-body shutter 37 moves from the closed position toward the open position. When the back end of the inner shutter 59 comes into contact with the front end of the main-body sealing member 36, the movement of the inner shutter 59 stops. Accordingly, only the shutter support 56 moves backward together with the cartridge K. In other words, the inner shutter 59 relatively moves from the closed position toward the open position.

Figure 9A:
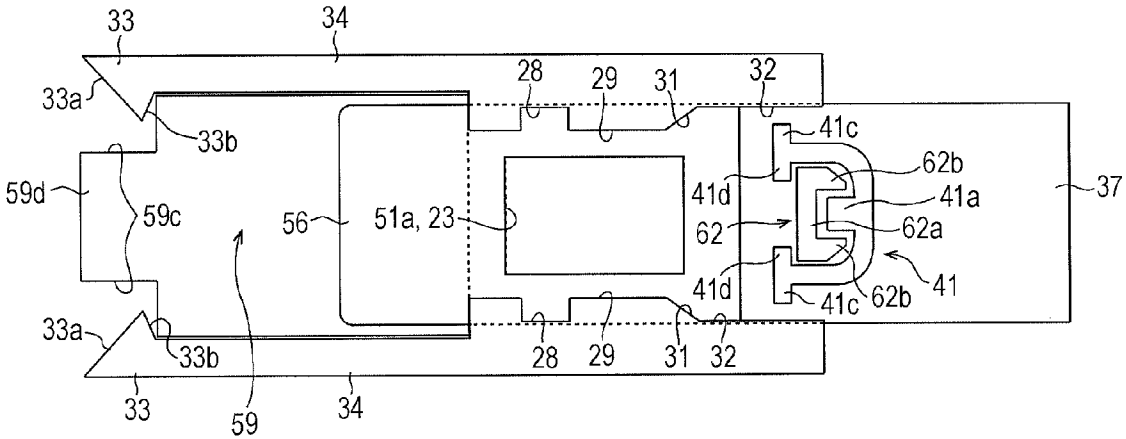
Figure 9B:
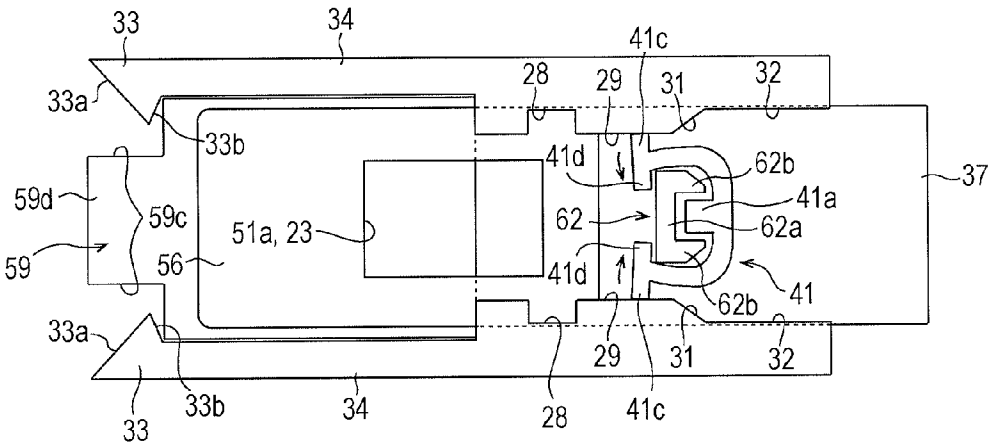

FIGS. 9A and 9B illustrate the states after the states in FIGS. 8A and 8B. FIG. 9A illustrates the state in which the cartridge K illustrated in FIG. 8B is further inserted and the insertion of the cartridge K is completed. FIG. 9B illustrates the state in which the cartridge K illustrated in FIG. 9A is pulled outward and deformation of the main-body key 41 is suppressed.

Referring to FIG. 9A, when the cartridge K is inserted to the deepest position, as illustrated in FIG. 3, the shutters 37 and 57 are moved to the respective open positions, and the outlet 51*a* and the supply hole 23 are connected to each other, as illustrated in FIG. 9A. In this state, the developer may be supplied from the cartridge K to the reservoir tank RT.

In the state illustrated in FIG. 9A, the shutter support 56 of the cartridge K is moved backward such that the engagement cancelling portions 58 are separated from the notched portions 59*c* in the inner shutter 59. Accordingly, as illustrated in FIG. 9A, the locking claws 33 are released from the engagement cancelling portions 58 and the lock arms 34 elastically restore their original shapes such that the notched portions 59*c* are placed between the locking claws 33. In this state, movement to of the inner shutter 59 in the front-back direction is restrained by the lock arms 34. In other words, the inner shutter 59 is locked by the lock arms 34.

Description of Cartridge Detaching Operation

When, for example, the cartridge K becomes empty and the cartridge K is to be removed, the cartridge K is pulled forward. When the cartridge K in the state illustrated in FIG. 9A is pulled forward, the inner shutter 59 is locked by the locking claws 33 of the lock arms 34 and cannot move. Accordingly, only the shutter support 56 moves forward together with the cartridge K. At this time, the cartridge key 62 is also locked by the main-body key 41, so that the main-body key 41 is also pulled forward as the cartridge key 62 on the cartridge K is moved forward. As a result, the main-body shutter 37 is also moved forward, that is, toward the closed position.

When the main-body shutter 37 is moved forward, the engagement arms 41*b* of the main-body key 41 receive a force that tries to push the engagement arms 41*b* away from each other from the cartridge key 62 that moves forward. However, in the present exemplary embodiment, the distance between the outer ends of the outer claw portions 41*c* corresponds to the distance between the broadening portions 32. Accordingly, even when the engagement arms 41*b* try to expand outward, the outer claw portions 41*c* come into contact with the broadening portions 32 and the engagement arms 41*b* cannot expand outward. Thus, the cartridge key 62 is prevented from being pulled out from the main-body key 41.

When the cartridge K is further pulled forward, the outer claw portions 41*c* of the main-body key 41 come into contact with the inclined portions 31 and the narrowing portions 29, so that the engagement arms 41*b* receive a force that pushes the engagement arms 41*b* inward. Accordingly, the cartridge key 62 is reliably prevented from being pulled out from the main-body key 41. Therefore, in the present exemplary embodiment, the risk that the keys 41 and 62 will be disengaged from each other and the main-body shutter 37 will be stopped at the open position or an intermediate position before the main-body shutter 37 returns to the closed position is reduced.

Figure 10:
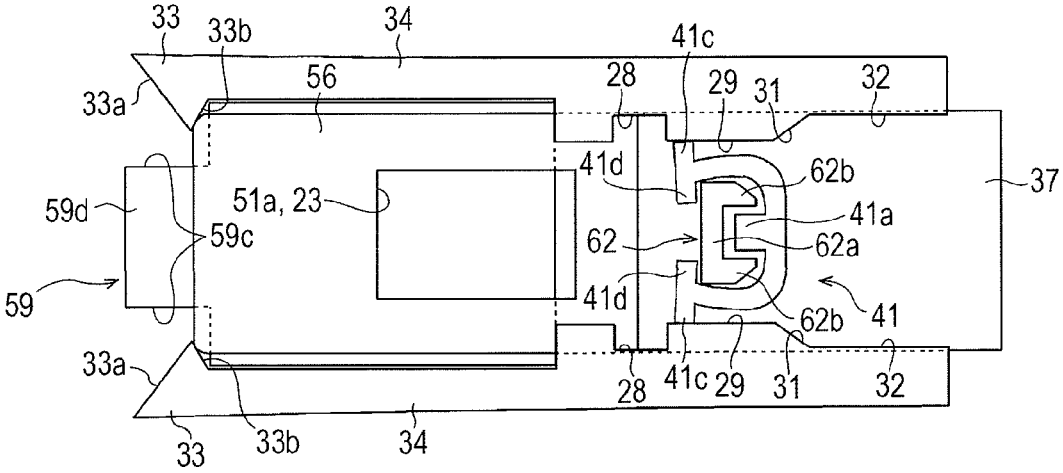
FIG. 10 illustrates the state after the state in FIG. 9B, in which the cartridge illustrated in FIG. 9B is further pulled outward and engagement cancelling portions are in contact with a shutter lock.

FIG. 10 illustrates the state after the state in FIG. 9B, in which the cartridge K illustrated in FIG. 9B is further pulled outward and the engagement cancelling portions 58 are in contact with the shutter lock 21.

When the cartridge K is moved forward and reaches the position illustrated in FIG. 10, the engagement cancelling portions 58 come into contact with the back end faces 33*b* of the locking claws 33. Then, when the cartridge K in this state is further moved forward, the locking claws 33 are pushed outward by the engagement cancelling portions 58 and the lock arms 34 are elastically deformed outward. Accordingly, the state illustrated in FIG. 8B is established, so that the inner shutter 59 returns to the closed position and is released from the locked state. Then, as the cartridge K is moved forward, the inner shutter 59 is moved forward together with the shutter support 56 while the outlet 51*a* is blocked by the inner shutter 59.

When the cartridge K reaches the position illustrated in FIG. 8B, the main-body shutter 37 is moved to the closed position and the supply hole 23 is blocked by the main-body shutter 37. Then, forward movement of the main-body shutter 37 is restrained by a stopper (not shown). In this state, the outer claw portions 41*c* are at positions corresponding to the accommodation recesses 28, so that the engagement arms 41*b* are allowed to be elastically deformed outward. Therefore, when the cartridge K in the state illustrated in FIG. 8B is further moved forward, the engagement arms 41*b* are pushed away from each other, as illustrated in FIG. 8A, and the cartridge key 62 is pulled out from the main-body key 41. Accordingly, when the cartridge K is further moved forward, the cartridge K is set to the states illustrated in FIGS. 7B and 7A in that order, and then the outer shutter 67 is guided by the first projection guide groove 14 and is moved to the closed position. Thus, the cartridge K is detached while the outlet 51*a* in the cartridge K is blocked by both the inner shutter 59 and the outer shutter 67 and the supply hole 23 is blocked by the main-body shutter 37.

In the structure of the related art, a projection that projects from a cartridge may be provided to release a shutter on the cartridge from a locked state. In contrast, in the cartridge K according to the present exemplary embodiment, such a projection is not formed and the locked state is canceled by using the engagement cancelling portions 58 which are provided on the shutter support 56. In the structure of the related art, the projection is located at a position separated from the shutter, and therefore the overall size of the structure is increased. Accordingly, the size of the cartridge is increased. In addition, an expensive mold is used to form the projection, and there is a risk that the projection will break. The present exemplary embodiment addresses these problems. In particular, in the present exemplary embodiment, the engagement cancelling portions 58 are formed integrally with the shutter guides 57, and may be easily formed.

In addition, in the cartridge K according to the present exemplary embodiment, two shutters, which are the inner shutter 59 and the outer shutter 67, are provided. If, for example, the projection is provided as in the structure of the related art, it is necessary to form the outer shutter 67 such that the outer shutter 67 covers the projection. In such a case, the size of the outer shutter 67 increases. In contrast, in the present exemplary embodiment, the engagement cancelling portions 58 are provided on the shutter support 56. Therefore, the size of the outer shutter 67 may be reduced.

In addition, in the cartridge K according to the present exemplary embodiment, the extension guide 59*d* capable of guiding the outer shutter 67 is formed on the inner shutter 59. If, for example, the extension guide 59*d* is not provided, the outer shutter 67 is not supported by any guide portion at the front side thereof when the outer shutter 67 is close to the closed position. In such a case, the outer shutter 67 cannot be stably moved and there is a risk that the outer shutter 67 cannot be closed or the outer shutter 67 will fall from the cartridge K. If a guide portion is formed on the cartridge body 51 to prevent this, the guide portion will interfere with the movement of the inner shutter 59. The cartridge K according to the present exemplary embodiment, in which the extension guide 59*d* is formed on the inner shutter 59, addresses these problems.

Modifications

Although an exemplary embodiment of the present invention is described in detail above, the present invention is not limited to the above-described exemplary embodiment, and various modifications are possible within the scope of the present invention defined by the claims. Modifications (H01) to (H05) of the present invention will now be described below.

(H01) Although the copy machine U is described as an example of an image forming apparatus, the image forming apparatus is not limited to this, and may instead be, for example, a printer, a facsimile machine, or a multifunction machine having the functions of these machines. In addition, the image forming apparatus is also not limited to a monochrome image forming apparatus, and may instead be a multicolor image forming apparatus.

(H02) In the above-described exemplary embodiment, the cartridge K that contains fresh developer that is to be supplied to the developing device G is described as an example of a developer container. However, the developer container is not limited to this, and may instead be, for example, a waste toner box that contains developer that is collected from the photoconductor cleaner CLp or the belt cleaner CLb. The present invention may be applied to a portion of, for example, a detachable developing device G or the like that serves as a container that contains developer therein and that is detachably attached to the transporting device body in the image forming apparatus.

(H03) In the above-described exemplary embodiment, the engagement cancelling portions 58 are formed integrally with the shutter guides 57. However, the engagement cancelling portions are not limited to this, and may instead be configured such that the engagement cancelling portions do not serve as the shutter guides but as stoppers that prevent the inner shutter 59 from being detached, or such that the engagement cancelling portions do not provide any function other than the engagement cancelling function.

(H04) Although two shutters are provided on the cartridge in the above-described exemplary embodiment, the structure of the cartridge is not limited to this. For example, the outer shutter 67 may be omitted and only the inner shutter 59 may be provided, as in the structure of the related art.

(H05) In the above-described exemplary embodiment, the structures of the shutter lock 21, the main-body key 41, the cartridge key 62, etc., are not limited to the above-described structures, and may be changed as appropriate in accordance with the design, usage, and other factors. For example, although the lock'arms 34, the engagement arms 41*b*, the insertion portions 62*b*, etc., are provided in pairs to be arranged at the left and right sides, these components may instead be provided at only one of the left and right sides. In addition, the main-body shutter 37 may be omitted. In such a case, the main-body key 41 and the cartridge key 62 are also be omitted.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developer transporting device comprising:

a developer container including a containing portion that contains the developer therein and that has a connection hole, a first opening-closing member that opens or closes the connection hole, and a guide portion that guides the first opening-closing member in a direction for opening or closing the connection hole; and a container holder that supports detachably the developing container, the container holder having a movement restraining member which contacts with the first opening-closing member to restrain the first opening-closing member from moving relative to the container holder when the developer container is attached to the container holder, wherein the guide portion pushes the movement restraining member so that the movement restraining member releases the first opening-closing member while the developer container moves relative to the container holder to detach from the container holder.

2. The developer transporting device according to claim 1, further comprising:

a second opening-closing member arranged outside the first opening-closing member and supported such that the second opening-closing member is movable between a second open position and a second closed position, the first opening-closing member being exposed when the second opening-closing member is at the second open position and covered when the second opening-closing member is at the second closed position.

3. The developer transporting device according to claim 2, wherein an extension guide is formed integrally with the first opening-closing member, and guides the second opening-closing member.

4. The developer transporting device according to claim 2, wherein an outer opening-closing projection is formed on an outer surface of the second opening-closing member and projects outward.

5. An image forming apparatus comprising:

an image carrier that rotates;

a developing device that forms a visible image by developing a latent image formed on a surface of the image carrier;

a transfer device that transfers the visible image from the surface of the image carrier to a medium;

a fixing device that fixes the visible image that has been transferred onto the medium; and a developer transporting device according to claim 1, the developer transporting device transporting the developer to the developing device.

* * * * *